US006491576B1

(12) United States Patent
Vogel-Zaugg

(10) Patent No.: US 6,491,576 B1
(45) Date of Patent: Dec. 10, 2002

(54) GRINDING TOOL

(75) Inventor: Josef Vogel-Zaugg, Horw (CH)

(73) Assignee: Botech AG, Stans (CH)

( * ) Notice: Subject to any disclaimer, the term of this patent is extended or adjusted under 35 U.S.C. 154(b) by 0 days.

(21) Appl. No.: 09/806,664

(22) PCT Filed: Feb. 10, 1998

(86) PCT No.: PCT/CH98/00422

§ 371 (c)(1),
(2), (4) Date: Aug. 15, 2001

(87) PCT Pub. No.: WO00/20171

PCT Pub. Date: Apr. 13, 2000

(51) Int. Cl.[7] ..... B24B 45/00
(52) U.S. Cl. ..... 451/496; 451/502; 451/508
(58) Field of Search ..... 451/496, 502, 451/503, 508, 547

(56) References Cited

U.S. PATENT DOCUMENTS

| | | | | |
|---|---|---|---|---|
| 2,259,475 A | * | 10/1941 | Koethler | 15/104.011 |
| 3,869,833 A | | 3/1975 | Belanger | 51/334 |
| 4,517,773 A | | 5/1985 | Heiden | 51/336 |
| 4,882,880 A | * | 11/1989 | Schaffner et al. | 15/181 |
| 5,157,874 A | * | 10/1992 | Peng | 451/461 |
| 5,355,639 A | * | 10/1994 | Ferard et al. | 451/28 |
| 6,163,917 A | * | 12/2000 | Bown | 15/179 |

* cited by examiner

*Primary Examiner*—Timothy V. Eley
*Assistant Examiner*—Alvin J. Grant
(74) *Attorney, Agent, or Firm*—Pearne & Gordon LLP

(57) ABSTRACT

A grinding tool has radially projecting grinding elements separated by spacers. The grinding elements are provided with radially extending slots. Some of the slots are open-ended. Axially spaced slots alternate in different radial positions.

11 Claims, 3 Drawing Sheets

GRINDING TOOL

BACKGROUND OF THE INVENTION

This invention relates to a grinding tool with a drive shaft and radial grinding elements.

There exist numerous grinding tools for machine-operated abrasive surface finishing. Examples of such traditional machines include rotary grinders employing a grinding medium in the form of a grinding sheet with an abrasive surface on a fabric, cellulose-based or plastic backing, radially extending from a motor-driven cylindrical base unit. The rotating tool is passed across the surface to be finished as the free ends of the grinding medium successively strike the surface and are moved across it. The tool may be part of an automatic system or it may be manually operated.

This conventional design is particularly useful when configured with a small tool diameter for finishing hard workpieces, for instance metal objects. When grinding workpieces of a soft material such as wood, there is always the danger of producing an uneven surface since the individual grinding elements attack the material at different force levels. This problem takes on increasingly significant proportions after the break-in period of the tool when due to usage the grinding elements have differently shaped ends. For finishing larger workpieces it becomes necessary to apply the grinder in machine-controlled fashion or to manually go over the entire surface repeatedly to cover the whole area, a process which is time-consuming and once again tends to pose a problem in achieving a homogeneous finish.

For larger workpieces the dimensions of the tool should be larger as well, especially with respect to its operating width. For conventional grinding tools, however, that would create major problems in terms of grinding performance since they would necessarily be quite stiff and inflexible over their width, making the grinding of non-planar, curved surfaces of a soft material virtually impossible.

The U.S. Pat. No. 3,869,833 describes a grinding tool with a drive shaft from which grinding elements, mounted on a carrier band, project radially outward. Each grinding element is attached to a retaining pin that is positioned at a distance from and parallel to the drive shaft. The retaining pins are spaced from one another and attached, along a circular path around the drive shaft, to a base unit.

BRIEF SUMMARY OF THE INVENTION

It is the objective of this invention to introduce a grinding tool which is capable of also finishing workpieces of a soft material such as wood and having a curved surface.

According to the invention, this capability is provided by a grinding tool with the features per claim 1.

Other preferred design versions are characterized by the features described in the subordinated claims 2 to 11.

By virtue of the design of the grinding tool according to this invention, a tool is provided which, even when it is large or has a large working width, is capable of following curved contours as a well and indeed lends itself particularly well to the surfacing of workpieces of a soft material such as wood. It is an advantage of this design that it permits the tool to be relatively wide, i.e. with a large effective operating width, thus permitting even large, curved workpieces to be surface-finished in just a few steps. It is especially the surfaces of three-dimensionally cambered objects that can be finished quickly and in optimal fashion even when the workpiece consists of a soft material such as wood.

As an added benefit, the tool according to this invention is highly durable and is relatively easy to maintain.

While the tool according to this invention is particularly suitable for the finishing of soft workpieces, it is also well suited to the grinding of workpieces with a hard and/or straight surface.

BRIEF DESCRIPTION OF THE SEVERAL VIEWS OF THE DRAWING

The following describes a design example of this invention in more detail with the aid of the attached drawings in which.

DETAILED DESCRIPTION OF THE INVENTION

Figure 1:
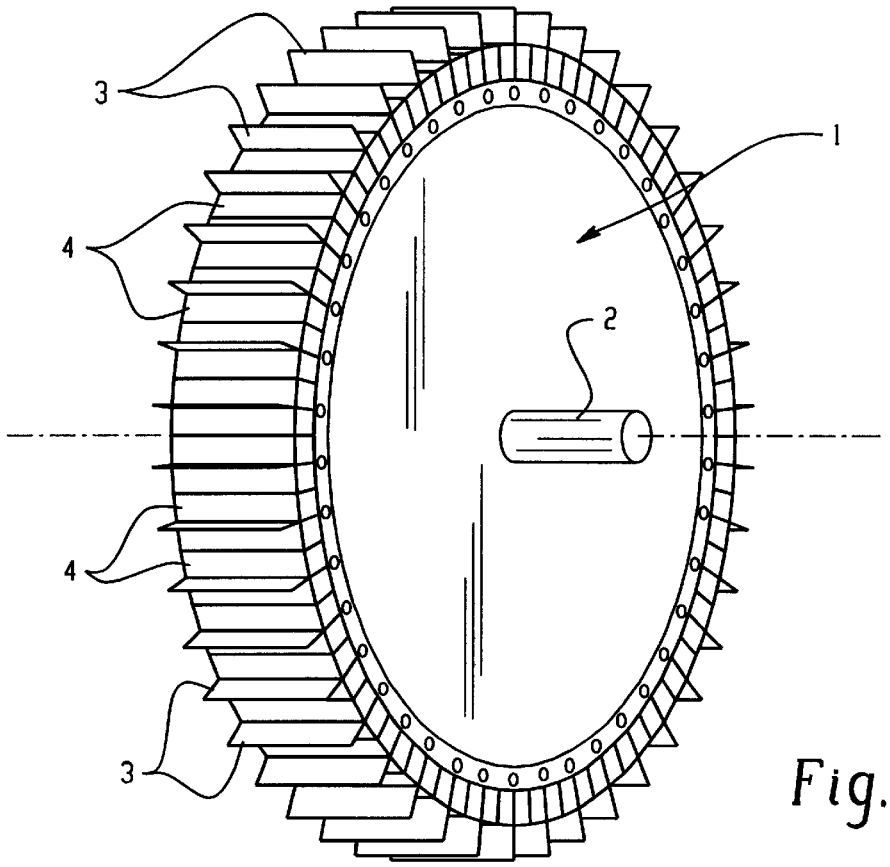
FIG. 1 is a schematic view of the grinding tool per this invention.

FIG. 1 is a schematic illustration of a grinding tool according to this invention. The grinding tool incorporates a cylindrical base unit with drive shaft 2 attached to which are blade-shaped grinding elements 3 radially protruding at an angle. Located between the grinding elements 3 are spacers 4 which serve to keep the grinding elements 3 apart and in position.

The rotary grinding tool is set in motion by a motor via the drive shaft 2 and then tangentially brought up to the workpiece to be processed. Alternatively, the grinding tool may be set up in a stationary position and the workpiece to be processed is tangentially brought up to the rotating grinding tool for instance by a pick-up arm which may be numerically controlled.

Figure 2:
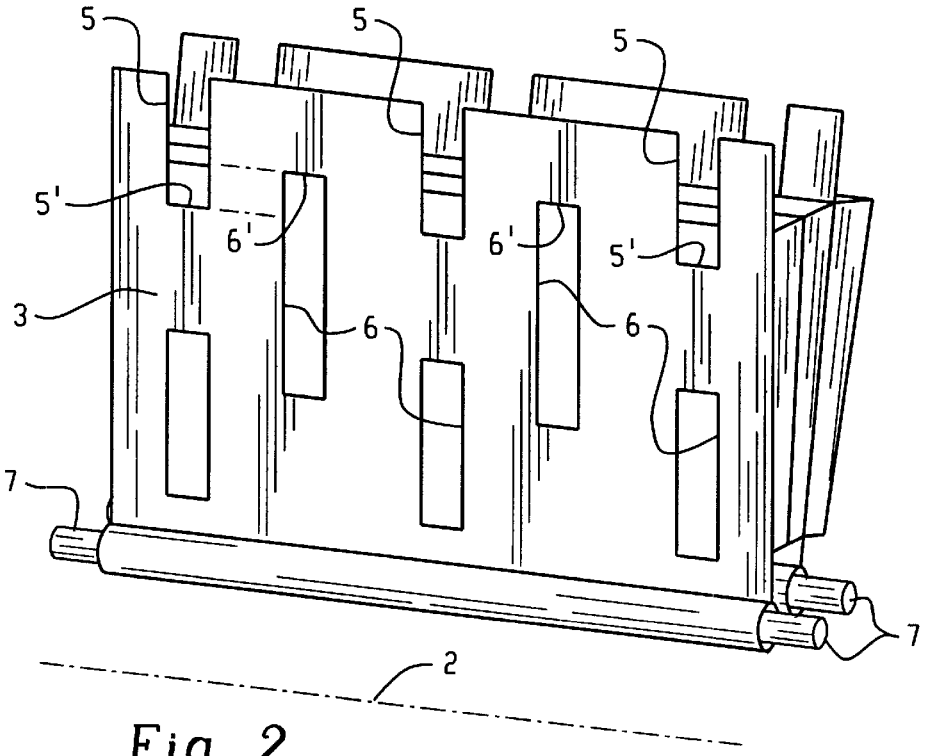
FIG. 2 is a partial, detailed illustration of the grinding elements of a tool per FIG. 1.

FIG. 2 is a partial view of one of the blade-shaped grinding elements 3. In this case, the grinding element 3 is essentially reactangular and is provided with slots 5, 6 which extend in an essentially radial direction relative to the drive shaft 2 of the grinding tool. These slots 5, 6 may be for instance rectangular. The slots 5 extending toward the free end of the grinding element 3 preferably reach all the way to the open, distal edge of the grinding element 3, i.e. the slots are open-ended. The slots 6 which are located further inward in the direction of the drive shaft 2 are arranged in a way that their upper edge 6' is farther away from the drive shaft 2 than the lower edges 5' of the slots 5, meaning that the neighboring slots 5, 6 overlap in a mutually offset fashion.

This configuration of the grinding elements 3 makes up a continuous array of contiguous grinding elements 3 whose slots 5 and 6 virtually separate their free ends into individually and independently deflectable vanes, thus forming a flexible grinding edge which can follow even strongly curved three-dimensional contours. This provides in advantageous fashion for a good, homogeneous grinding effect without applying the excessive pressure that would be necessary in the case of a one-piece grinding element. It follows that even workpieces of a relatively soft material such as wood can be processed without an uneven or excessive removal of material by the grinding elements 3.

During the grinding process, the grinding elements 3 striking the workpiece to be processed are deflected, i.e. pushed away, against the direction of rotation of the drive unit. In practice it has been found that the positioning of the slots 5, 6 per this invention causes the individual edge sections of all grinding elements 3 to butt against one another, creating in desirable fashion a virtually uninterrupted grinding surface. For a homogeneous finish on strongly contoured workpieces it is desirable to mount the grinding elements 3 on the base unit 1 in staggered fashion so that for juxtapositioned grinding elements 3 their slots 5 and/or 6 are not directly aligned one behind the other but are laterally offset by at least a slot width or more.

The grinding elements are composed, in conventional fashion, of a flat carrier or substrate material supporting on one side or both sides an abrasive grinding layer consisting for instance of emery or corundum granules. The carrier substrate or backing may consist of a cellulose or synthetic material.

Figure 3:
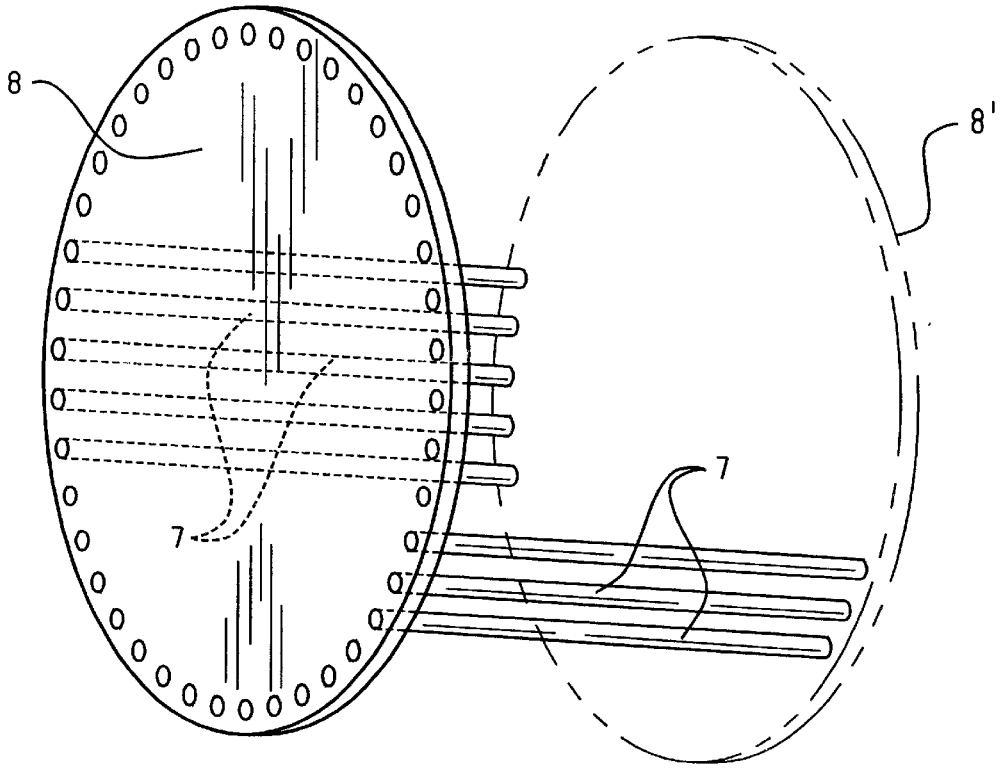
FIG. 3 is a partial view of the basic, retaining-pin-equipped base unit of the grinding tool per FIG. 1.

According to the invention, the grinding elements 3 are attached to the grinding tool, i.e. the base unit 1 of the grinding tool, by means of retaining pins 7. FIG. 3 is a partial view of a section of the base unit 1, showing the mounting disk 8 for the retaining pins 7. The preferably cylindrical retaining pins 7, individually rotatable around their longitudinal axes, are seated in holes drilled into the mounting disk 8. For simplicity's sake, FIG. 3 shows only one mounting disk 8 with a few retaining pins 7 while the opposite mounting disk 8' is indicated by a dotted line only.

Figure 4:
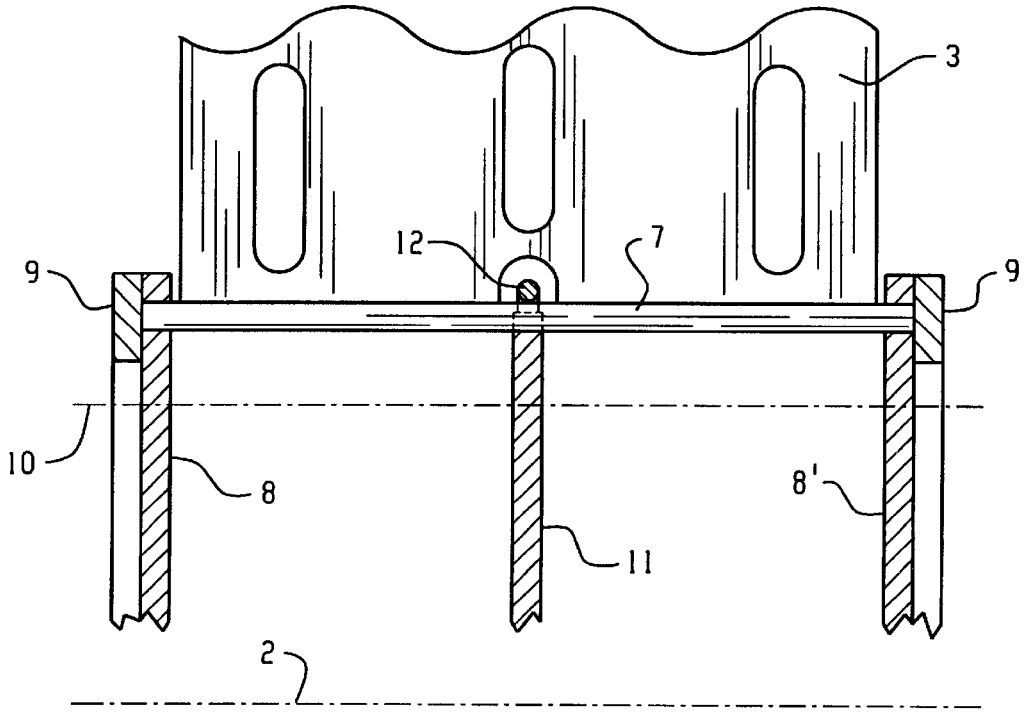
FIG. 4 is a longitudinal section through a design variant of the grinding tool in the area of the grinding element.

FIG. 4 shows in a more detailed longitudinal section view the outer region of the base unit 1 with both mounting disks 8 and 8' and a mounted retaining pin 7. The retaining pins 7 are secured against axial displacement by means of rings 9 provided on the outside of the mounting disks 8 and 8'. The rings 9 are clamped together by way of clamping provisions 10 for instance in the form of through-bolts which thus also connect the mounting disks 8 and 8'.

Since for weight and stability reasons the retaining pins 7 must be kept small, it may in certain cases be desirable to interposition between the two mounting disks 8 and 8' additional support disks 11. Instead of drilled round holes as in the case of the mounting disks 8 and 8', these support disks 11 are provided with semicircular or U-shaped slots opening toward the outside, through which the retaining pins 7 can be radially inserted from the outside. As a preferred additional provision, a retaining wire 12 is attached around the perimeter of the support disk 11. Its purpose, especially in high-speed operation, is to prevent the retaining pins 7 from bending outward under the load to which they are exposed or, in extreme situations, from being pulled out of the corresponding holes in the mounting disks 8 or 8'. The retaining wire thus serves primarily as a safety device which can be secured against the drive shaft 2 of the base unit 1 of the grinding tool by means of suitable fasteners.

Figure 5:
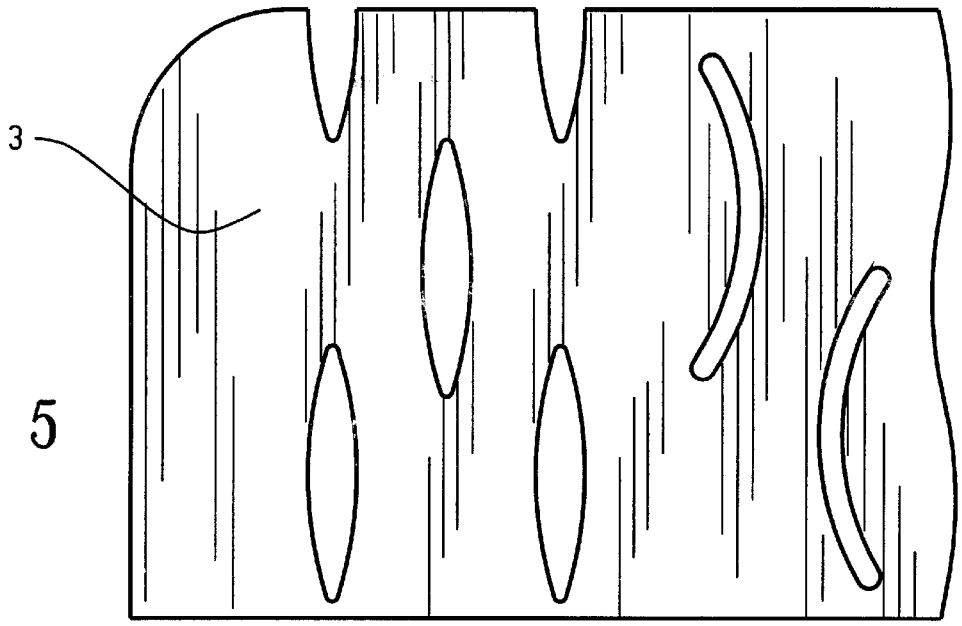
FIG. 5 shows a design variation of the grinding element.

The corners of the grinding elements 3 may be radiused as in the design variant illustrated in FIG. 5. Similarly, the slots 5 may have rounded corners, they may be lens-shaped or follow a slightly curved or undulating longitudinal line.

Figure 6:
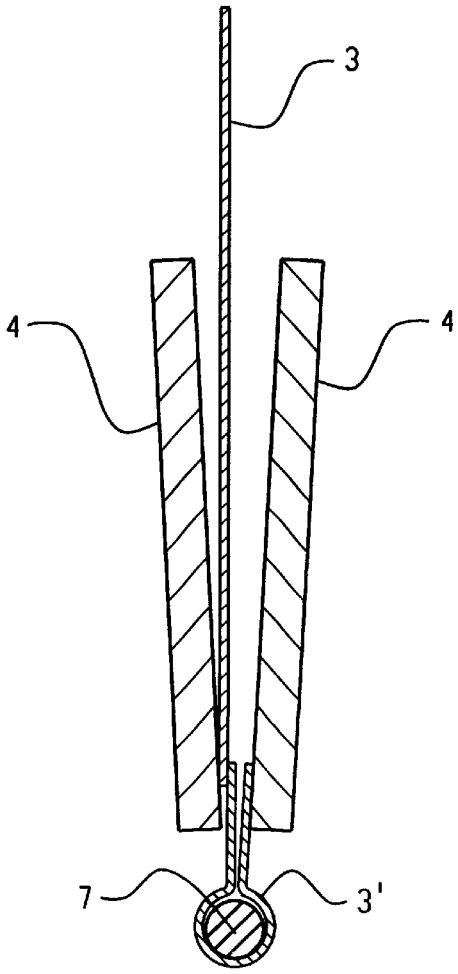
FIG. 6 is a section view of a grinding element with retaining pin and spacers.

FIG. 6 is a section view of the grinding element 3 mounted on a retaining pin 7. As an example, the lower section of the grinding element 3 may be provided with an eye 3' which can be slipped over the retaining pin 7. Of course, the grinding elements 3 may be attached to the retaining pins 7 in other ways as well, for instance by insertion in mounting slots in the pins 7.

Two spacers 4 are mounted for instance on both sides of the grinding element as shown in FIG. 4. The spacers 4 are preferably of the same width as the grinding elements 3 but shorter. The spacers 4 may be directly connected to the adjoining sides of the grinding elements 3, for instance by gluing, or they may be mutually interconnected in which case the connector, for instance a clamp or a rivet, extends through a corresponding perforation in the grinding element 3. Preferably, the spacers 4 are connected to the grinding element 3 or interconnected with one another only at the bottom of the grinding element 3 and rest freely, in a radial arrangement, against the outside surface of the grinding element 3.

The grinding tool per this invention is particularly suitable for the one-step processing of large, three-dimensionally shaped workpieces. The design according to this invention offers the benefit of allowing for large dimensions of the grinding tool, with a diameter preferably greater than 500 mm (19.7"), which makes the processing of such workpieces in one single operation possible. In spite of their large dimensions, the grinding elements 3, provided according to this invention with slots 5, 6, constitute a flexible effective grinding surface over the entire width of the tool, thus also permitting the processing of soft materials, especially wood.

What is claimed is:

1. Grinding tool with a drive shaft (2) and with grinding elements (3) which in relation to the drive shaft project outward in radial fashion and incorporate abrasive substances mounted on a flexible carrier band, each grinding element (3) mounted on a retaining pin (7) that is located at a distance from and parallel to the drive shaft (2), which retaining pins (7) are attached to a base unit (1) at a distance from one another and in a circular arrangement around the drive shaft (2), wherein spacers (4) are positioned between, and extend over at least part of, all mutually neighboring grinding elements (3), wherein the grinding elements (3) are each provided with slots (5, 6) extending substantially radially in relation to the drive shaft (2) and at least part of which are open-ended slots (5) in the direction of the free end of the respective grinding element (3), and wherein the slots (5, 6), spaced apart from one another, alternate in at least two radially different positions relative to the drive shaft.

2. Grinding tool as in claim 1, wherein the slots (5, 6) are evenly spaced from one another and are all of identical dimensions.

3. Grinding tool as in claim 1 or 2 wherein a lower end section overlaps (5'), an upper end section (6') of neighboring slots (5, 6) of a given grinding element (3) in the radial direction.

4. Grinding tool as in claim 3, wherein the radially overlapping slots (5, 6) of adjacent grinding elements (3) are offset in the axial direction by at least the width of the slots (5, 6).

5. Grinding tool as in claim 1, wherein the retaining pins (7) are in the form of pivot-mounted round rods capable of rotating around their longitudinal axis.

6. Grinding tool as in claim 1, wherein the ends of the retaining pins (7) extend into boreholes of mounting disks (8) which form a part of the base unit (1).

7. Grinding tool as in claim 1, wherein the base unit (1) is provided on each side with a mounting disk (8, 8') and wherein at least one support disk (11) is located between and parallel to the mounting disks (8, 8') and radially extends at least to the retaining pins (7).

8. Grinding tool as in claim 7, wherein a retaining wire (12) tightly surrounds the perimeter of the support disk (11) radially outside, but preferably in external contact with, the retaining pins (7).

9. Grinding tool as in claim 1, wherein the spacers (4) are elastic pads preferably consisting of a synthetic material or natural fibers.

10. Grinding tool as in claim 1, wherein the spacers (4) are in each case attached, on one or on either side, preferably to only a bottom section of the respective grinding element (3).

11. Grinding tool as in claim 1, wherein the grinding tool has a diameter of at least 500 mm (19.7").

* * * * *

UNITED STATES PATENT AND TRADEMARK OFFICE

CERTIFICATE OF CORRECTION

PATENT NO. : 6,491,576 B1
DATED : December 10, 2002
INVENTOR(S) : Josef Vogel-Zaugg It is certified that error appears in the above-identified patent and that said Letters Patent is hereby corrected as shown below:

Title page,
Item [56], References Cited, please add the following:
-- OTHER PUBLICATIONS
Patent Abstract of Japan, Sankyo Rikagaku KK, Vol. 096, No. 181, Pub. Sept. 1982 30, Filed June 3, 1982, 1998, Pub. No. 57089566, 1 page.

Patent Abstract of Japan, Nagasaki Taku, Vol. 096, No. 004, Pub. April 1996, Filed December 1995, Publication No. 07314337, 1 page.

Patent Abstract of Japan, Three F Giken: KK, Vol. 096, No. 006, Pub. June 1996, Filed February 1996, Publication No. 08039437, 1 page. --

Signed and Sealed this

Third Day of June, 2003

JAMES E. ROGAN
*Director of the United States Patent and Trademark Office*